United States Patent [19]

Russo

[11] Patent Number: 4,898,053

[45] Date of Patent: Feb. 6, 1990

[54] SOCKET WRENCH EXTENSION WITH EXTENSIBLE MAGNET

[76] Inventor: Anthony Russo, 18 Briar Hill Rd., Cedar Grove, N.J. 07009

[21] Appl. No.: 103,452

[22] Filed: Oct. 1, 1987

[51] Int. Cl.[4] ..... B25B 23/00; B25G 3/02

[52] U.S. Cl. ..... 81/125; 81/177.2

[58] Field of Search ..... 81/125, 177.2, 900; 7/901

[56] References Cited

U.S. PATENT DOCUMENTS

| | | | |
|---|---|---|---|
| 2,624,223 | 1/1953 | Clark | 81/125 |
| 2,677,294 | 5/1954 | Clark | 81/125 |
| 2,718,806 | 9/1955 | Clark | 81/177.85 X |
| 3,126,774 | 3/1964 | Carr et al. | 81/125 |

*Primary Examiner*—D. S. Meislin

*Attorney, Agent, or Firm*—Thomas L. Adams

[57] ABSTRACT

A socket wrench extension is used with one of a plurality of removable sockets having different depths. The extension has a threaded magnetic head and a shank. The shank has a driving and driven end. A threaded axial bore extends into the driving end but falls short of the driven end. The driven end has a drive receiving portion. The shank also has at its driving end a polygonal portion with a polygonal cross-section. The magnetic head is threaded partially into the bore to extend beyond the driving end. Thus the threaded magnetic head can be adjustably extended from the driving end to bring the magnetic head into a position consistent with the different depths of the removable sockets.

5 Claims, 1 Drawing Sheet

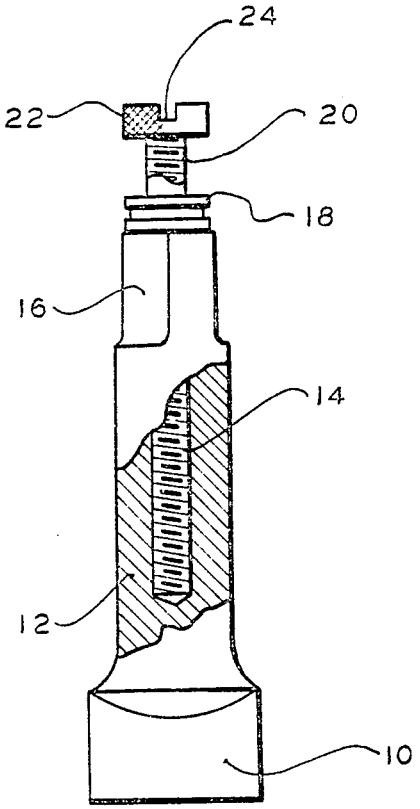
24
22
20
18
16
14
12
10

SOCKET WRENCH EXTENSION WITH EXTENSIBLE MAGNET

SUMMARY OF THE INVENTION

In combination, a socket wrench extension having a drive receiving first end portion, a shank portion, and a socket mounting second end portion, and said shank portion, and socket mounting second end portion being hollow, and said hollow cavity of the shank portion, and socket mounting second end portion have a screw thread, and said screw thread shank portion and socket mounting second end portion accomodate a screw thread metallic stem, and said screw thread metallic stem have as an integral part a magnetic head, and said screw thread mettalic stem with magnetic head be extensible from the said screw thread shank portion and socket mounting second end portion by manually turning the screw-thread metal stem with magnetic head in and out of the screw-thread shank portion and socket mounting second end portion, and said screw-thread stem with magnetic head being able to hold in engagement a metallic body in the internal portion of a socket wrench, when said socket wrench is attached to said screw-thread shank portion and socket mounting second end portion.

BRIEF DESCRIPTION OF DRAWING

This frontal view of the socket wrench extension shows the drive receiving first end portion, a cutaway view of the shank portion showing the screw-thread cavity, the socket mounting second end portion with a snap ring locking mechanism, and a screw-thread metallic stem with a magnetic head.

DETAILED DESCRIPTION OF DRAWING

This frontal view with cutaway, shows a steel socket wrench extension with an extensible magnet. This drawing comprises eight (8) distinct features numbered ten to twenty four (10–24). These features in numerical character references are, a drive receiving first end portion (#10), the external shank portion (#12), the internal shank portion with screw-thread (#14), the socket mounting second end portion (#16), a snap-ring socket locking mechanism (#18), the screw-thread stem (#20), a knurled magnetic head (#22) and a screw-driver slot in the magnetic head (#24).

This tool is a socket wrench extension which now incorporates not only the unique characteristic of the magnetic head 24, but also affords the versatility of an extensible magnet, when the intended application of the magnetic feature is needed in various depth socket wrenches. The socket wrench extension contains some features which are familiar to existing extensions. Among these features are, a drive receiving first end portion 10, a shank portion 12, and a socket mounting second end portion 16 using a snap-ring socket locking mechanism 18. The materials used in this socket wrench extension is the type of steel most commonly used in this type of application.

The disclosed embodiment consists of the addition of a magnetic material at the tip of the socket mounting second end portion 16 of the extension having the added feature of being extensible from within the extension. The uniqueness of having a magnet and it being extensible gives added dimension to the versatility of this tool. The addition of the magnet affords the user of this extension the ability to hold in engagement a nut or bolt (not shown) in the internal portion of a socket wrench, while this socket wrench is manipulated in different positions. This feature eliminates the possibility of the metallic body being dropped and thus facilitates the intended task. The addition of the extensible feature while working with this tool permits the use of deep socket wrenches, where the nut or bolt (not shown) can at the same time be both held in position by the magnet, and be restrained from slipping down into the socket (not shown) when pressure is applied. This is accomplished by manually turning the magnet or by using the screw driver slot 24 at the end of the magnet 22 to reach a desired setting. Once the desired position is attained, the screw thread on the magnet stem acts as a stop, restraining the nut or bolt (not shown) from moving into the socket (not shown).

The extension will have various dimensions in accordance with a specific size drive, ranging from ¼ inch drive and upward. The magnetic head 22 will be one size in depth, with an extensible stem 20 whose length and diameter will vary in relation to the length and diameter of a specific size drive. The magnet 22 will have a diameter that shall not exceed the surface diameter of the socket-mounting second end portion 16 of a particular size drive. The magnet head 22 will be an integral part of the metallic stem 20, with the screw-thread stem 20 being equal in length to that of the screw-thread internal portion 14 of the shank portion, and socket mounting second end portion 16 of the extension.

I claim:

1. A socket wrench extension for use with one of a plurality of removable sockets having different depths, comprising:

a threaded stem having a magnetic head; and a shank having a driving and driven end, and a threaded axial bore extending into said driving end but falling short of said driven end, said driven end having a drive receiving portion, said shank having at said driving end a polygonal portion with a polygonal cross-section for engagement with an opening in a removable socket, said threaded stem being threaded partially into said bore to extend said magnetic head beyond said driving end, so that said magnetic head can be adjustably extended from said driving end to bring said magnetic head into a position consistent with the different depths of said removable sockets.

2. A socket wrench extension according to claim 1 wherein said magnetic head comprises:

a cylindrical cap having a diameter exceeding that of said stem.

3. A socket wrench extension according to claim 2 wherein the circumferential side of said cap has a rough surface and is sized to permit manipulation.

4. A socket wrench extension according to claim 3 further comprising:

a snap ring socket locking mechanism mounted at said driving end.

5. A socket wrench extension according to claim 4 wherein said cap has an outwardly facing slot.

* * * * *